US006882805B2

(12) United States Patent
Mizuno

(10) Patent No.: US 6,882,805 B2
(45) Date of Patent: Apr. 19, 2005

(54) IMAGE FORMING APPARATUS THAT HEATS A FIXING DEVICE AND THAT REDUCES A WARM-UP PERIOD

(75) Inventor: Masanaka Mizuno, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/615,949

(22) Filed: Jul. 10, 2003

(65) Prior Publication Data

US 2004/0009000 A1 Jan. 15, 2004

(30) Foreign Application Priority Data

Jul. 11, 2002 (JP) ..... 2002-202432

(51) Int. Cl.[7] ..... G03G 15/00; G03G 15/20

(52) U.S. Cl. ..... 399/45; 399/69

(58) Field of Search ..... 399/45, 67, 69

(56) References Cited

FOREIGN PATENT DOCUMENTS

| | | | | |
|---|---|---|---|---|
| JP | 04191878 A | * | 7/1992 | ..... G03G/15/20 |
| JP | 04331967 A | * | 11/1992 | ..... G03G/15/20 |
| JP | 6-348163 A | | 12/1994 | |
| JP | 07325496 A | * | 12/1995 | ..... G03G/15/20 |
| JP | 2001-109322 A | | 4/2001 | |

* cited by examiner

*Primary Examiner*—Quana Grainger
(74) *Attorney, Agent, or Firm*—Foley & Lardner LLP

(57) ABSTRACT

In an image forming apparatus which includes a fixing device having a coil divided into a plurality of systems, allocation of power amounts to be supplied to the respective systems of the coil is determined based on the size of paper.

15 Claims, 7 Drawing Sheets

IMAGE FORMING APPARATUS THAT HEATS A FIXING DEVICE AND THAT REDUCES A WARM-UP PERIOD

CROSS-REFERENCE TO RELATED APPLICATIONS

This application is based upon and claims the benefit of priority from the prior Japanese Patent Application No. 2002-202432, filed Jul. 11, 2002, the entire contents of which are incorporated herein by reference.

BACKGROUND OF THE INVENTION

1. Field of the Invention

This invention relates to an image forming apparatus such as a copying machine, printer, facsimile device and the like having a fixing device and a control method for the image forming apparatus.

2. Description of the Related Art

Conventionally, image forming apparatuses, such as copying machines, printers, facsimiles, etc. heat a fixing device so as to fix a toner image on paper used as a recording medium.

For example, an image forming apparatus which controls the heating operation of a heater provided in the fixing device based on the width of paper on which a toner image is formed is described in Jpn. Pat. Appln. KOKAI Publication No. 2001-109322 or Jpn. Pat. Appln. KOKAI Publication No. 6-348163.

However, in the conventional image forming apparatus described above, since a portion which is not required to be heated is also heated due to the configuration thereof, there occurs a problem in the energy efficiency.

BRIEF SUMMARY OF THE INVENTION

An object of this invention is to provide an image forming apparatus which can efficiently heat a fixing device and reduce a warm-up period, based on the size of paper which is required to be subjected to a fixing process when a warm-up process for the fixing device is performed, and a control method for the image forming apparatus.

According to one aspect of this invention, an image forming apparatus which forms an image on a recording medium comprises an image input section, which inputs an image, a size selection section, which selects a size of a recording medium on which an image input by the image input section is formed, a toner image forming section which forms a toner image of the image input by the image input section on the recording medium with the size selected by the size selecting section, a fixing section having a fixing member which heats and fixes the toner image formed on the recording medium by the toner image forming section onto the recording medium and a heater divided into a plurality of systems used to respectively heat a plurality of divided regions of the fixing member, and a control section which determines allocation power amounts to be supplied to the respective systems of the heater according to the size of the recording medium selected by the size selecting section and supplies the allocation power amounts to the respective systems of the heater when the fixing member is required to be warmed up.

A control method for an image forming apparatus of this invention which includes an image input section which inputs an image, a toner image forming section which forms a toner image of the image input by the image input section on a recording medium with a selected one of various sizes, and a fixing section having a fixing member which heats and fixes the toner image formed on the recording medium by the toner image forming section onto the recording medium and a heater divided into a plurality of systems used to respectively heat a plurality of divided regions of the fixing member, comprises inputting an image by use of the image input section, selecting the size of a recording medium on which the image input by the image input section is formed, and determining allocation power amounts to be supplied to the respective systems of the heater according to the selected size of the recording medium and supplying the power amounts allocated to the respective systems of the heater to the respective systems of the heater when the fixing member is required to be warmed up.

DETAILED DESCRIPTION OF THE INVENTION

There will now be described an embodiment of this invention with reference to the accompanying drawings.

In the embodiment explained below, it is assumed that the long side of A5-size paper, the short side of A4R-size paper, the long side of A4-size paper and the short side of A3-size paper are defined as the width directions of the respective sheets of paper (recording media). Further, it is assumed that the short side of A5-size paper, the long side of A4R-size paper, the short side of A4-size paper and the long side of A3-size paper are defined as the lengthwise directions of the respective sheets of paper.

Figure 1:
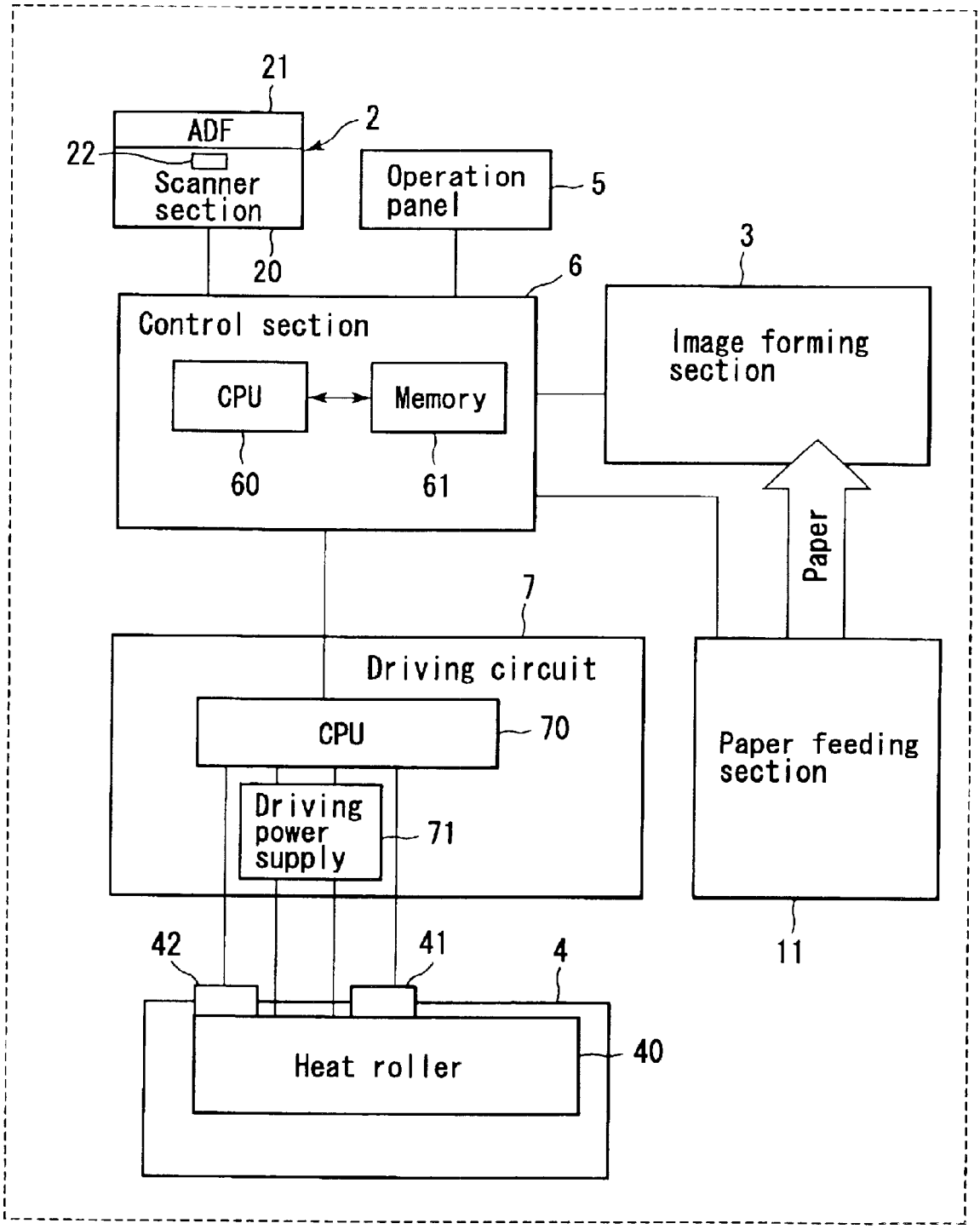
FIG. 1 is a block diagram showing a copying machine.

FIG. 1 is a block diagram showing a copying machine 1 used as an image forming apparatus.

As shown in FIG. 1, the copying machine 1 includes a scanner section 2, image forming section 3, fixing device 4, operation panel 5, control section 6, driving circuit 7 and paper feeding section 11. In this example, it is assumed that the copying machine 1 can print (form) an image or data on paper with the width of A4R-size paper to the width of A3-size paper.

The operation panel 5 is a user interface to which an operation command from the user is input. The operation panel 5 supplies an operation command input from the user to the control section 5.

The scanner section 2 functions as an image input section. The scanner section 2 includes a scanner body 20, auto document feeder (ADF) 21, and document size sensor 22. The scanner body 20 optically reads an image of an document and converts the thus read image into image data. The auto document feeder 21 feeds documents set on a document table (not shown) one by one to a document reading position of the scanner body 20. Further, the document size sensor 22 senses the size of a document placed on a document placing glass plate or the size of a document supplied to the document reading position by the ADF 21. The size of the documents set on the ADF 21 is sensed based on the width with respect to the feeding direction of the document and the length in the feeding direction.

The paper feeding section 11 includes a plurality of paper feeding stages, for example. In the respective paper feeding stages, sheets of paper used as recording media of various sizes are received. The paper feeding section 11 selectively feeds the sheets of paper of various sizes (A3, A4, A4R, A5, . . . ) received in each of the paper feeding stages in response to a command from the control section 6 and supplies the thus selected paper to the image forming section 3.

The printer section 3 forms a toner image on paper supplied from the paper feeding section 11. For example, the printer section 3 forms a toner image corresponding to an image input by the scanner section 2 on paper.

The fixing device 4 includes a heat roller 40 and temperature sensors (central portion temperature sensor, end portion temperature sensor) 41, 42. The fixing device 4 heats and fixes a toner image formed on paper by the image forming section 3 onto the paper by use of the heat roller 40. The central portion temperature sensor 41 senses a temperature of the central portion of the heat roller 40. The end portion temperature sensor 42 senses a temperature of the end portion of the heat roller 40.

The driving circuit 7 is a circuit which supplies a high-frequency current (electric power) to the fixing device 4. The driving circuit 7 includes a CPU 70, driving power supply 71 and the like. The driving circuit 7 acquires temperature information indicating the temperatures of the heat roller 40 sensed by the temperature sensors 41, 42.

The driving circuit 7 has a function of performing a warm-up process in which the temperature of the heat roller 40 is raised to a preset fixing temperature and a function of controlling the temperature of the heat roller 40 within a preset temperature range.

The control section 6 controls the whole portion of the copying machine 1 and controls the respective portions of the copying machine 1 according to a preset sequence. The control section 6 is connected to the scanner section 2, image forming section 3, operation panel 5, driving circuit 7 and paper feeding section 11 via a data bus. The control section 6 acquires information from the respective portions of the copying machine 1 and issues instructions to the respective portions of the copying machine 1 to perform various processes. Further, the control section 6 has functions of controlling the driving circuit 7, selecting the size of paper on which an image is formed, and storing a plurality of images and outputting the images in a desired order (a function of rearranging the order of the images).

Further, the control section 6 includes a CPU 60, memory 61 and the like. The CPU 60 processes information input from the exterior or instructions and information stored in the memory 61. The CPU 60 executes a process based on a control program stored in the memory 61.

The memory 61 stores the control program, control data necessary for the operations of the respective portions of the copying machine 1, information input from the operation panel 5, an image of the document read by the scanner section 2 and the like. For example, as the control data necessary for the operations of the respective portions of the copying machine 1, a table indicating the relation between electric power amounts supplied to a central coil 44 and end coils 45 which will be described later and a period of time required for the heat roller 40 to reach the fixing temperature and parameters used for calculations are provided.

With the above configuration, in the control section 6, images of a plurality of documents read by the scanner section 2 can temporarily be stored in the memory 61, the order of the plurality of images stored in the memory 61 can be rearranged and the images can be output to the image forming section 3.

Figure 2:
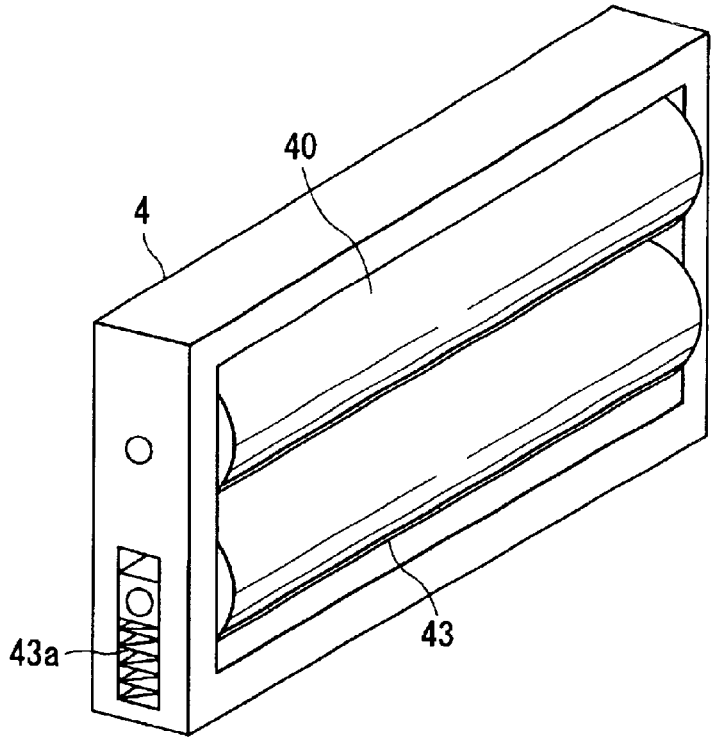
FIG. 2 is a perspective view showing a fixing device.

FIG. 2 is a diagram showing an example of the configuration of the fixing device 4.

As shown in FIG. 2, the fixing device 4 includes the heat roller 40 and a press roller 43 pressed against the heat roller 40 by use of a spring 43*a*. For example, the heat roller 40 is rotated at a preset speed by use of a driving motor (not shown) via a transmission mechanism such as a pulley or belt (not shown). Paper on which a toner image is formed is passed through a pressed portion between the heat roller 40 and the press roller 43. The toner image is fixed onto the paper which has passed through the pressed portion between the heat roller 40 and the press roller 43.

Figure 3:
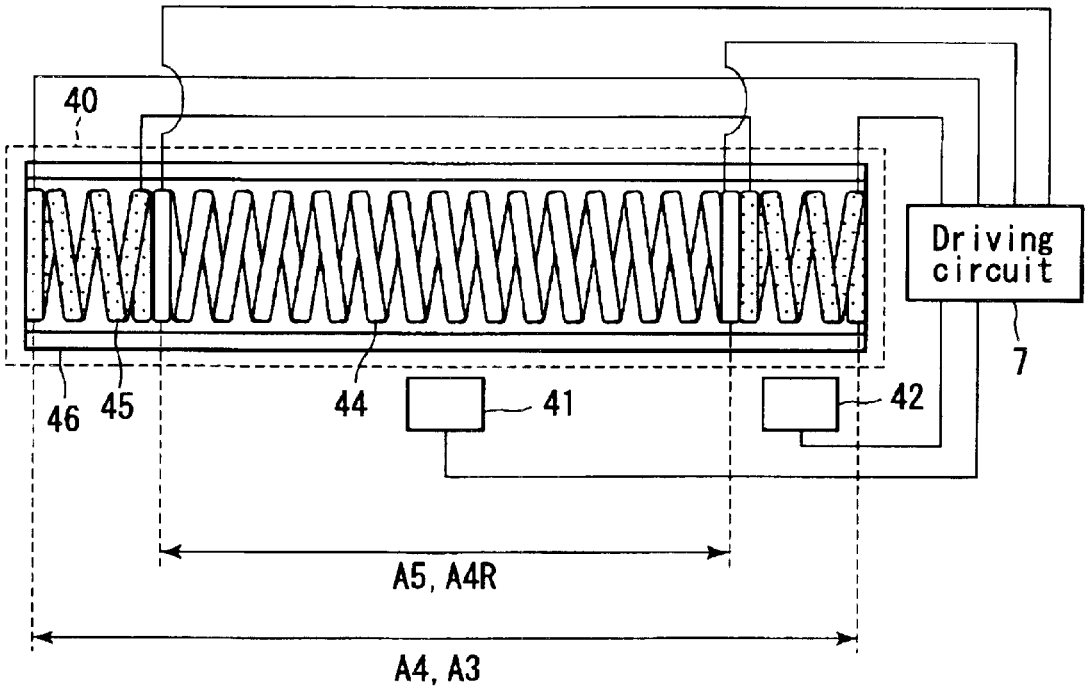
FIG. 3 is a cross sectional view schematically showing a heat roller.

FIG. 3 is a cross sectional view schematically showing the configuration in the fixing device 4.

In FIG. 3, a sheet of paper used as a recording medium is set so that the central position of the paper width thereof will pass through a central part of the pressed portion between the heat roller 40 and the press roller 43. As shown in FIG. 3, when paper passes through the pressed portion, the direction of the paper is set with the width direction of the paper set parallel to the heat roller 40.

As shown in FIG. 3, the heat roller 40 includes the central portion temperature sensor 41, end portion temperature sensor 42, central coil 44, end coils 45 and sleeve 46. The sleeve 46 is configured by a cylindrical member formed of a conductive material such as aluminum, stainless alloy or carbon steel. The width of the sleeve 46 is made larger than the width of A3-size paper used as the maximum size of paper which can be subjected to the fixing process by the fixing device 4. A thermal-separation resistant layer formed of fluororesin coated on the peripheral portion of the cylindrical member is formed on the sleeve 46. The central coil 44 and end coils 45 used as the heater are arranged inside the cylindrical member used as the sleeve 46.

The heater is divided into two systems, for example, into the central coil 44 and end coils 45. The central coil 44 and end coils 45 used as the heater are arranged in close proximity to the inner surface of the cylindrical member used as the sleeve 46.

As shown in FIG. 3, the central coil 44 is arranged to heat a portion corresponding to the A5 width of the central portion of the sleeve 46. In the following description, a region (a region corresponding to the central coil 44) on the sleeve 46 which the central coil 44 heats is defined as a central portion.

As shown in FIG. 3, the end coils 45 are arranged to heat the end portions of the sleeve 46 other than the heating range of the central coil 44. In the following description, regions (regions corresponding to the end coils 45) on the sleeve 46 which the end coils 45 heat are defined as end portions.

The central coil 44 and end coils 45 are supplied with high-frequency currents (electric power) from the driving circuit 7. When supplied with high-frequency currents from the driving circuit 7, the central coil 44 and end coils 45 cause changes in high-frequency magnetic fields. The sleeve 46 is formed of a conductive member. Therefore, the sleeve 46 causes an induction current according to a change in the high-frequency magnetic field generated by the central coil 44 or end coils 45 to generate Joule heat.

On the central portion of the sleeve 46, the central portion temperature sensor 41 is disposed. The central portion temperature sensor 41 is used to sense a temperature of the central portion of the sleeve 46. Temperature information sensed by the central portion temperature sensor 41 is supplied to a CPU 70 of the driving circuit 7. The CPU 70 of the driving circuit 7 determines the temperature of the central portion of the sleeve 46 based on the temperature information sensed by the central portion temperature sensor 41. Further, the CPU 70 of the driving circuit 7 controls the electric power amount of the high frequency current supplied to the central coil 44 from the driving power supply 71 based on the temperature of the central portion of the sleeve 46.

On the end portion of the sleeve 46, the end portion temperature sensor 42 is disposed. The end portion temperature sensor 42 is used to sense a temperature of the end portion of the sleeve 46. Temperature information sensed by the end portion temperature sensor 42 is supplied to the CPU 70 of the driving circuit 7. The CPU 70 of the driving circuit 7 determines the temperature of the end portion of the sleeve 46 based on the temperature information sensed by the end portion temperature sensor 42. Further, the CPU 70 of the driving circuit 7 controls the electric power amount of the high frequency current supplied to the end coil 45 from the driving power supply 71, based on the temperature of the end portion of the sleeve 46.

The size (width) of the whole portion of the sleeve 46 is set based on the maximum size (maximum paper size) of a recording medium to be subjected to the fixing process. For example, the size of the sleeve 46 is designed based on the maximum paper size of paper which can be printed by the copying machine.

Further, the size (width) of the central coil 44 may be designed according to the minimum paper size. For example, when the copying machine 1 is designed to cope with paper of a size corresponding to a post card, the size of the central coil 44 may be set to correspond to the size of the post card. The sizes can thus be determined.

The end coils 45 are not necessarily required to heat the remaining whole portion other than the central portion of the sleeve 46 and there occurs no problem if they can cope with the maximum paper width of paper which the copying machine 1 can print.

In the present embodiment, a case wherein the sizes (widths) of the sleeve 46, central coil 44 and end coils 45 of the heat roller 40 are designed to correspond to the paper sizes of A5, A4R, A4 and A3 is explained, but they can be designed to correspond to other paper sizes.

Next, the operation of the copying machine 1 is explained.

The copying machine 1 has a sleep mode in which supply of electric power to the heat roller 40 is interrupted for energy saving when it has not been used for a preset period of time or in a time zone in which the frequency of usage thereof is extremely lowered.

In the copying machine 1, a warm-up process which raises the temperature of the heat roller 40 to a preset fixing temperature is performed when the operation mode is changed from the sleep mode to a normal operation mode (ready state) or when the operation of the copying machine is started. A period in which the warm-up process is performed is called a warm-up period. That is, supply of electric power to the heat roller 40 is interrupted when the main power supply of the copying machine is set in the OFF state or the operation mode of the copying machine is set in the sleep mode. Therefore, the temperature of the heat roller 40 is kept lower than the fixing temperature. Thus, when a command for specifying start of the image forming process is issued in the sleep mode or when the main power supply of the copying machine 1 is turned ON, the warm-up process which raises the temperature of the heat roller 40 to the fixing temperature is performed.

Figure 4:
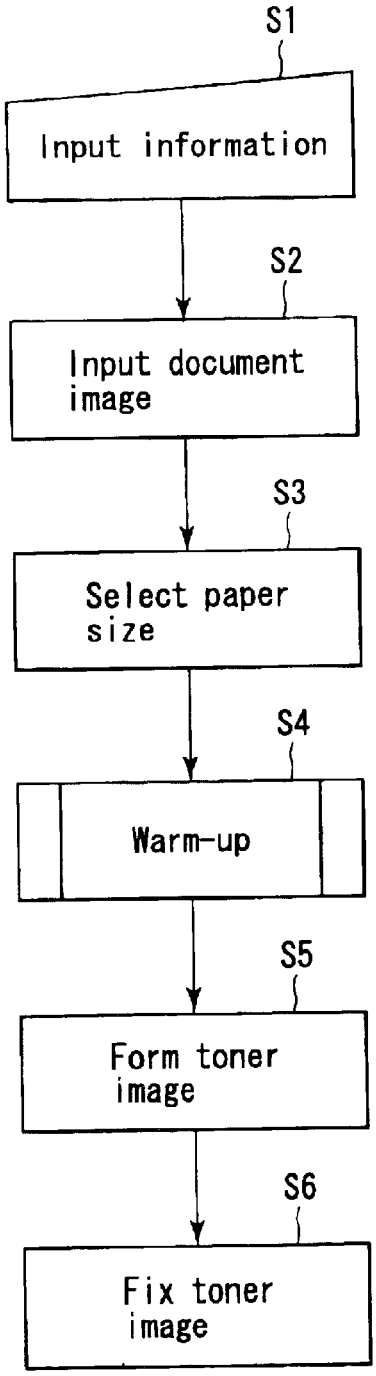
FIG. 4 is a flowchart for illustrating a first operation example of an image forming apparatus.
Figure 5:
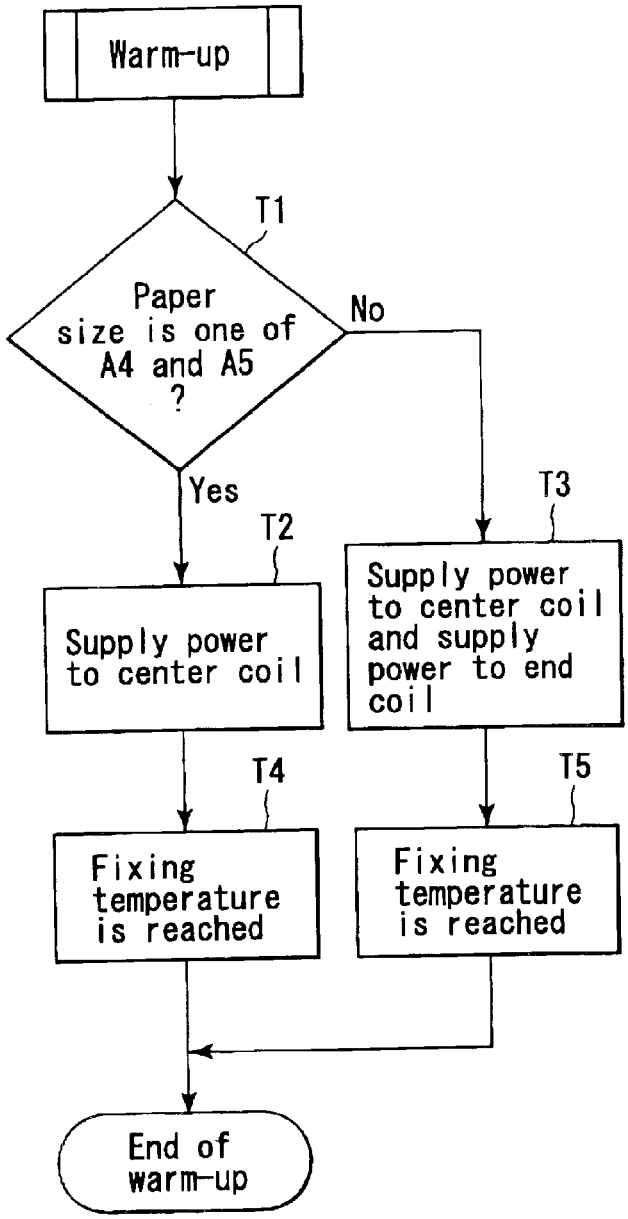
FIG. 5 is a flowchart for illustrating a warm-up process in the first operation example.

FIGS. 4 and 5 are flowcharts for illustrating an example of the first operation of the copying machine 1.

In the first operation example, first, it is assumed that the user sets a document on the scanner section 2 and inputs various information items by use of the operation panel 5 in the sleep mode (rest state) in which no electric power is supplied to the heat controller 40. In this case, for example, the user inputs information items of enlargement/reduction, document size, paper size and the like indicating enlargement or reduction of a document image by use of the operation panel 5.

Information input by use of the operation panel 5 is supplied from the operation panel 5 to the control section 6 when the user operates a start key to specify start of the copying operation (S1).

As a result, the control section 6 makes operation settings of various portions based on information items (a magnification factor of enlargement/reduction, document size, paper size and the like) supplied from the operation panel 5. After making the operation settings based on the information supplied from the operation panel 5, the control section 6 specifies inputting of a document image to the scanner section 2 (S2).

According to the above specification, the scanner section 2 reads the image of the document set by the user and converts the image into image data. The image data is supplied to the control section 6. When the scanner section 2 has a document size sensing section 2*a*, the scanner section 2 supplies information indicating the document size sensed by the document size sensing section 2*a* to the control section 6 together with the image data.

The control section 6 which has received the image data of the document from the scanner section 2 determines (selects) the size of paper used based on the magnification factor of enlargement/reduction and document size or specified paper size and the like supplied from the operation panel 5 (S3).

When the paper size is determined, the control section 6 issues an instruction to the driving circuit 7 to warm up the heat roller 40 (S4). At this time, the control section 6 supplies information indicating the paper size to the driving circuit 7 together with the warm-up execution instruction.

If the warm-up process of the heat roller 40 is completed, the control section 6 causes the paper feeding section 11 to feed paper with the size determined and supplies the image data of the document read by the scanner section 2 to the image forming section 3. The image forming section 3 forms a toner image on the paper fed from the paper feeding section 11 based on the image data supplied from the control section 6 (S5).

After forming the toner image on the paper fed from the paper feeding section 11, the image forming section 3 supplies the paper having the toner image formed thereon to the fixing device 4. The fixing device 4 fixes the toner image onto the paper having the toner image formed thereon and supplied from the image forming section 3 (S6).

Next, the warm-up process of the step S4 is explained more in detail.

FIG. 5 is a flowchart for illustrating a warm-up process in the step S4.

The driving circuit 7 which has received the warm-up execution instruction from the control section 6 executes the warm-up process of the heat roller 40.

In the warm-up process, the driving circuit 7 allocates and supplies preset total supply electric power to the central coil 44 and end coils 45 according to the size of paper on which an image specified by the control section 6 is formed (T1). In this case, the total supply electric power is preset power which can be supplied to the fixing device 4 or may be power which varies depending on power amounts supplied to the respective portions.

For example, when the paper size is A5 or A4R, that is, when the size of paper on which a toner image can be fixed only by use of the central portion of the sleeve 46 is used, the driving circuit 7 supplies no electric power to the end coils 45 and supplies all of the total supply electric power to the central coil 44 (T2). In this case, since the amount of a current generated in the sleeve 46 increases as the amount of electric power supplied to the specified coil increases, the effect that the temperature of a corresponding portion can be rapidly raised can be attained.

Further, when the paper size is A4 or A3, that is, when the size of paper on which a toner image is required to be fixed by use of the whole portion of the sleeve 46 is used, the driving circuit 7 allocates the total supply electric power to the central coil 44 and the end coils 45 and respectively supplies the allocated power amounts to the central coil 44 and the end coils 45 (T3).

It is preferable to allocate the electric power to be supplied to the central coil 44 and the electric power to be supplied to the end coils 45 so as to simultaneously and uniformly raise the temperatures of the central portion and end portions of the sleeve 46. In this case, it becomes possible to suppress a waste occurring in a period of time in which the temperature required to fix the toner image is reached (time necessary for the warm-up process) or in the efficiency of heating the sleeve 46 to the fixing temperature.

Allocation of the electric power to be supplied to the central coil 44 and the electric power to be supplied to the end coils 45 can be previously set so that the temperatures of the central portion and end portions of the sleeve 46 can be uniformly raised (so that the temperatures of the central portion and end portions will reach the fixing temperature at the same time). For example, the relation between the temperature rise of the sleeve 46 and the amount of electric power supplied to the central coil 44 and the relation between the temperature rise of the sleeve 46 and the amount of electric power supplied to the end coil 45 are previously acquired. Then, the allocation ratio of the electric power to be supplied to the central coil 44 and the electric power to be supplied to the end coil 45 may be determined based on the above relations so as to uniformly raise the temperatures of the central portion and end portion of the sleeve 46.

Further, the temperatures of the central portion and end portion of the sleeve 46 are monitored by use of the central portion temperature sensor 41 and end portion temperature sensor 42 and the electric power supplied to the central coil 44 and the electric power supplied to the end coil 45 may be changed on the real-time basis.

By performing the warm-up process as described above, the temperature of a region of the sleeve 46 which is necessary for fixing rises and reaches the preset fixing temperature at which the toner image is fixed on paper (T4, T5). When the temperature of the sleeve 46 has reached the fixing temperature, the driving circuit 7 terminates the warm-up process of the heat roller 40.

For example, when the paper size is A4R or A5 ("YES" in the step T1), the driving circuit 7 supplies electric power only to the central coil 44 (T2). In this case, even if the temperature of the end portion of the sleeve 46 does not reach the fixing temperature, the driving circuit 7 terminates the warm-up process when the temperature of the central portion of the sleeve 46 reaches the fixing temperature (T4).

After the end of the temperature rise (after the end of the warm-up process), the driving circuit 7 monitors the temperature of the central portion of the sleeve 46 by use of the central portion temperature sensor 41. Thus, the driving circuit 7 controls the temperature of the central portion of the sleeve 46 to be set within a temperature range which is necessary to fix the toner image on paper.

For example, when the temperature of the central portion of the sleeve 46 becomes lower than a temperature which is necessary to fix the toner image on paper, the driving circuit 7 supplies electric power to the central coil 44 and controls the temperature of the central portion of the sleeve 46 to reach the preset fixing temperature. If the temperature of the central portion becomes higher than the temperature which is necessary to fix the toner image on paper, the driving circuit 7 interrupts supply of electric power to the central coil 44.

Further, when the paper size is neither A4R nor A5, that is, when the paper size is A3 or A4, ("NO" in the step T1), the driving circuit 7 supplies electric power to the central coil 44 and end coil 45 to uniformly raise the temperature of the whole portion of the sleeve 46 (T3). In this case, when the temperature of the whole portion of the sleeve 46 reaches the fixing temperature (T5), the driving circuit 7 terminates the warm-up process.

When the paper size is A3 or A4, the driving circuit 7 monitors the temperatures of the central portion and end portions of the sleeve 46 by use of the central portion temperature sensor 41 and end portion temperature sensor 42 after the end of the temperature rise (after the end of the warm-up process). Thus, the driving circuit 7 controls the temperatures of the central portion and end portion of the sleeve 46 to be set within a range of temperatures which are required to fix the toner image on paper.

For example, when the temperature of the central portion or end portion of the sleeve 46 becomes lower than a temperature which is necessary to fix the toner image on paper, the driving circuit 7 supplies electric power to the central coil 44 or end coils 45 and controls the temperature of the central portion or end portion of the sleeve 46 to reach the preset fixing temperature. If the temperature of the central portion or end portion becomes higher than the temperature which is necessary to fix the toner image on paper, the driving circuit 7 interrupts supply of electric power to the central coil 44 or end coil 45.

As described above, in the warm-up process, the coil which heats the sleeve is selected according to the paper size and electric power is supplied only to the selected coil. As a result, a portion which is necessary for the fixing process is intensively heated.

Thus, the temperature of the region of the sleeve which is necessary for the fixing process can be rapidly raised according to the paper size and the warm-up period can be reduced. Further, time required for the whole process of the image forming operation can be reduced by reducing the warm-up period.

In the case of A5-size paper or A4R-size paper on which a toner image can be fixed only by use of the portion of the sleeve heated by the central coil 44, the driving circuit 7 intensively supplies electric power only to the central coil 44. As a result, the portion which is necessary for the fixing process is intensively heated.

Thus, the temperature of the central portion of the sleeve 46 can be rapidly raised and the warm-up period can be reduced. Further, time required for the whole process of the image forming operation can be reduced by reducing the warm-up period.

Next, the second operation example of the copying machine 1 is explained.

The second operation example is an operation example in a case wherein the image forming process is performed by use of sheets of paper (recording media) of various sizes. For example, when documents with different sizes are copied at a magnification of ×1 in the second operation example, images of the documents are rearranged for respective sizes and the copying operation is performed. That is, when documents of various sizes are copied at a magnification of ×1, the control section 6 temporarily stores images of the documents of various sizes read by the scanner 2 into the memory 61. After storing images of all of the documents into the memory 61, the control section 6 rearranges the images for the respective sizes of the documents. The control section 6 performs the image forming process for each image in a rearranged order. Thus, in the second operation example, electric power can be efficiently supplied to the coils 44, 45 of the fixing device 4.

Figure 6:
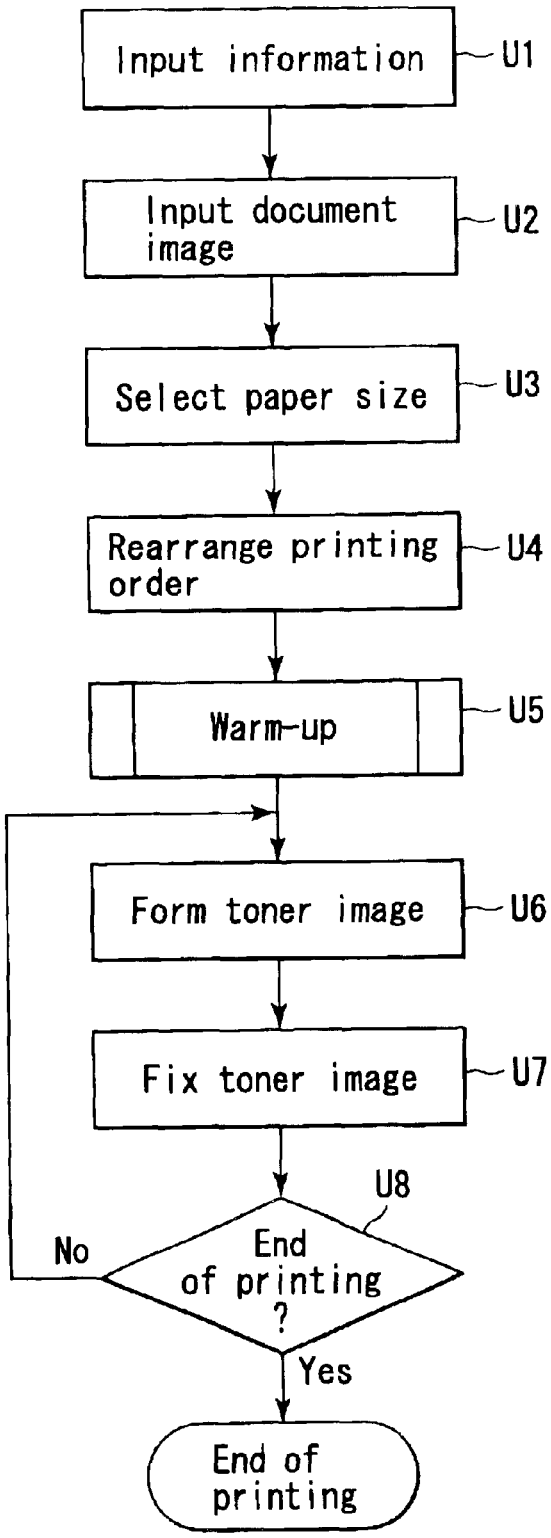
FIG. 6 is a flowchart for illustrating a second operation example of the image forming apparatus.

FIG. 6 is a flowchart for schematically illustrating the second operation example of the copying machine 1.

First, it is assumed that the user sets a plurality of documents of various sizes (A5, A4, A3, A3, A4, A4R, . . . ) on the ADF 21 and inputs various set information items by use of the operation panel 5 in the sleep mode (rest state) in which no electric power is supplied to the respective coils (central coil 44 and end coils 45) used as the heater of the fixing device 4.

For example, printing enlargement/reduction, document size, paper size and the like indicating enlargement or reduction of the document are input as the set information items via the operation panel 5. The various set information items input by use of the operation panel 5 are supplied from the operation panel 5 to the control section 6 (U1).

For example, a document size automatic sensing mode in which the document size sensor 22 senses the document size and a mode specified by the user are provided. In the document size automatic sensing mode, the sizes of the documents set on the ADF 21 can be sensed by the document size sensor 22.

Further, an automatic paper feeding mode in which the paper size is selected according to the document size and a mode in which the user specifies the paper size (or paper feeding stage) are provided. In the case of the automatic paper feeding mode, the control section 6 selects the size of paper used as a recording medium based on the document size, magnification factor of enlargement/reduction and the like. For example, in the case of the magnification factor of 100%, the control section 6 selects paper with the same size as the document size.

In this example, it is assumed that the document size is sensed in the document size automatic sensing mode and the paper size is selected according to the document size in the automatic paper feeding mode.

When an instruction which specifies start of copying is input by use of the operation panel 5, the control section 6 starts reading of the document set on the ADF 21 by use of the scanner 2. The scanner section 2 sequentially reads images of the documents with various sizes sequentially supplied from the ADF 21 (U2). Images read by the scanner section 2 are sequentially supplied to the control section 6. At this time, each document size is sensed by the document size sensor 22 and informed to the control section 6.

The control section 6 temporarily stores the image of the document supplied from the scanner section 2 in the memory 61. The control section 6 determines the size of paper used as a recording medium for each image stored in the memory 61 based on the set information input by the operation panel 5, the document size sensed by the document size sensor 22 and the like (U3). If an image modifying process to deform, enlarge or reduce the document image is necessary, the control section 6 subjects the document image to the image modifying process and then determines the paper size for each image.

When the paper size is determined for each image, the control section 6 divides the images into groups for the respective paper sizes (paper widths). After the images are divided into groups based on the paper sizes (paper widths), the control section 6 rearranges the images stored in the memory 61 in order of small paper size (paper width) (U4). That is, the control section 6 sets the printing order of the images stored in the memory 61 in order of small paper size (paper width).

For example, when sheets of paper with various sizes of A5, A4R, A4, A3 are used, the control section 6 first treats the sheets of A5 paper and A4R paper and then treats the sheets of A4 paper and A3 paper. In this example, in order to clarify the explanation, the width of the sheet of A5 paper and A4R paper is set as the first size and the width of the sheet of A4 paper and A3 paper is set as the second size (which is larger than the first size).

In the following explanation, images input by the scanner section 2 contain images to be formed on sheets of paper with the first size and images to be formed on sheets of paper with the second size which are arranged at random and the images are rearranged so that the images to be formed on sheets of paper with the second size will be placed before the images to be formed on sheets of paper with the first size.

After the order of the images is rearranged, the control section 6 causes the driving circuit 7 to perform the warm-up process of the fixing device 4 according to the order of the images (the printing order for the respective paper sizes) and the number of images for each paper size (the number of sheets of printing paper for each paper size) (U5). The warm-up process is explained in detail later.

When the warm-up process of the fixing device 4 by the driving circuit 7 is completed, the control section 6 starts the image forming process (U6).

The control section 6 issues information indicating the size of to-be-fed paper to the paper feeding section 11 based on the order of the images determined in the step U4. Then, the paper feeding section 11 sequentially supplies sheets of paper with the size specified by the control section 6 to the image forming section 3.

Further, the control section 6 sequentially supplies images stored in the memory 61 to the image forming section 3 in the order of the images determined in the step U4. Then, the image forming section 3 forms a toner image of the image supplied from the control section 6 on the paper fed from the paper feeding section 11.

The paper having the toner image formed thereon is supplied to the fixing device 4. Then, the fixing device 4 fetches the paper of the first size on which the toner image is formed by the image forming section 3 and fixes the toner image onto the paper (U7).

The process of the steps U6 and U7 is performed for each image stored in the memory 61. That is, the control section 6 first performs the image forming process for sheets of paper with the first size, and when the image forming process for the images with the first size is completed, the image forming process for sheets of paper with the second size is performed in the same manner as in the process of the steps U6 and U7.

The above operation is performed and the image forming process for all of the images is completed ("YES" in the step U8), the control section 6 terminates the copying operation.

Next, the warm-up process in the second operation example is explained.

Figure 7:
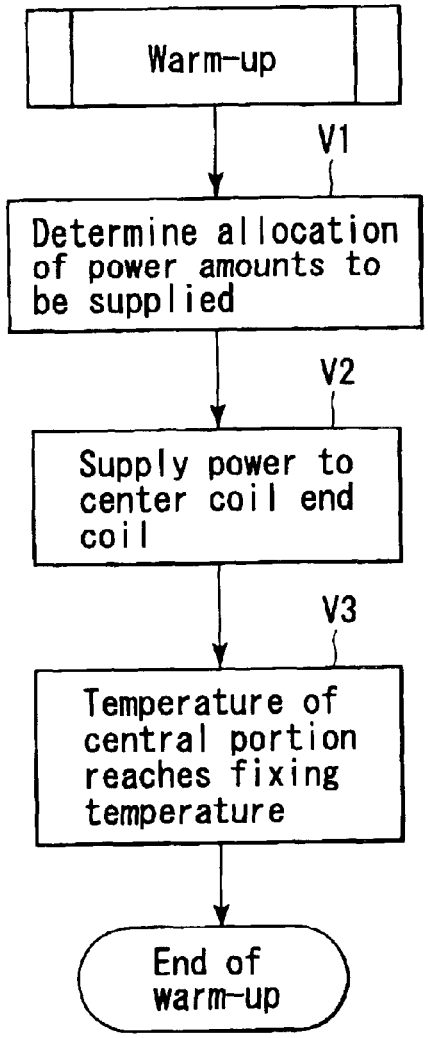
FIG. 7 is a flowchart for illustrating a warm-up process in the second operation example.

FIG. 7 is a flowchart for illustrating the warm-up process in the second operation example. The warm-up process shown in FIG. 7 corresponds to the warm-up process in the step U5 of FIG. 6.

When the warm-up process is started, the control section 6 determines allocation power amounts to be supplied to the coils 44, 45 based on the order of the images and the number of images for each paper size (V1). In this case, it is assumed that allocation of supply power amounts to the coils 44, 45 is determined based on data stored in the memory 61. For example, a table (or calculations) indicating the relation between electric power amounts supplied to the central coil 44 and end coils 45 and time required for the temperature of the sleeve 46 to reach the fixing temperature is stored in the memory 61. Allocation of supply power amounts to the coils 44, 45 may be determined by the driving circuit 7.

In this example, it is assumed that the fixing process for paper with the first size is first performed and then the fixing process for paper with the second size is performed. In this case, the control section 6 determines an amount of supply power to the end coil 45 which is required to raise the temperature of the end portion of the sleeve 46 to the preset fixing temperature by the time the toner image fixing process for the paper with the first size has been terminated (V1). Thus, allocation of an amount of electric power supplied to the central coil 44 and an amount of electric power supplied to the end coil 45 is determined.

After determining the allocation of the electric power amounts supplied to the coils 44, 45, the control section 6 issues a specification of the allocation of the supply electric power amounts to the driving circuit 7. In this case, it is assumed that the control section 6 specifies the electric power amount to be supplied to the end coil 45 and specifies the remaining electric power amount to be supplied to the central coil 44.

The driving circuit 7 supplies the electric power amount specified by the control section 6 to the end coil 45 and supplies the remaining electric power amount to the central coil 44 (V2). Thus, the temperatures of the central portion and end portion of the sleeve 46 are raised.

When the temperature of the central portion of the sleeve 46 has reached the preset fixing temperature at which the toner image is fixed on paper (V3), the driving circuit 7 terminates the warm-up process. When the warm-up process is terminated, the control section 6 starts the image forming process. Further, when the warm-up process is terminated, the temperature of the end portion of the sleeve does not always reach the preset fixing temperature. That is, the driving circuit 7 continuously supplies electric power to the end coil 45 until the temperature of the end portion of the sleeve 46 reaches the fixing temperature, even after the warm-up process is terminated.

After the temperature of the central portion or end portion of the sleeve 46 has reached the fixing temperature, the driving circuit 7 controls supply of electric power to the coils 44, 45 so as to keep the temperature of the central portion or end portion of the sleeve 46 within a preset temperature range.

As described above, in the second operation example, when a plurality of images are formed on sheets of paper of various sizes, the order of the images subjected to the image forming process is rearranged based on the sizes of the sheets of paper used. Then, the allocation electric power amounts to be supplied to a plurality of coils used to heat a plurality of regions of the sleeve are determined so as to efficiently perform the fixing process for sheets of paper with the respective sizes.

Thus, the electric power can be efficiently supplied to each coil, the warm-up period in the fixing device can be reduced and time required for a plurality of images to be subjected to the image forming process can be reduced.

Next, allocation of electric power amounts supplied to the coils 44, 45 is explained.

Figure 8A:
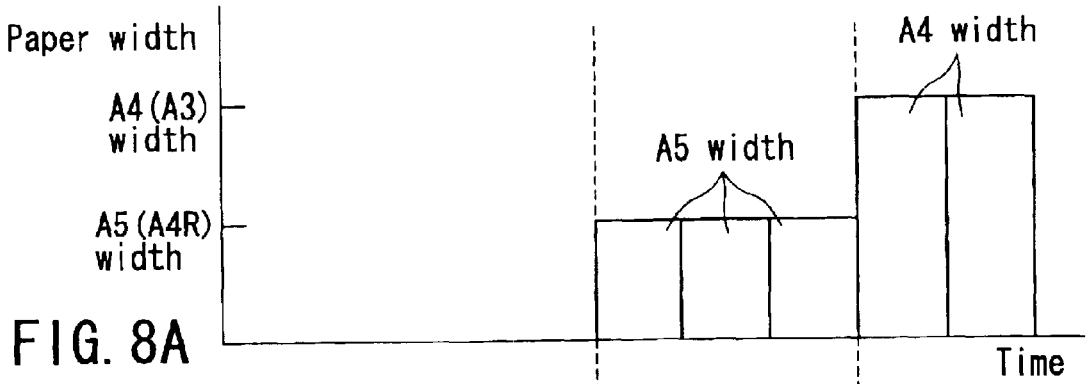
FIG. 8A is a diagram showing an example of a time chart of various sizes of recording media supplied to a fixing device.
Figure 8B:
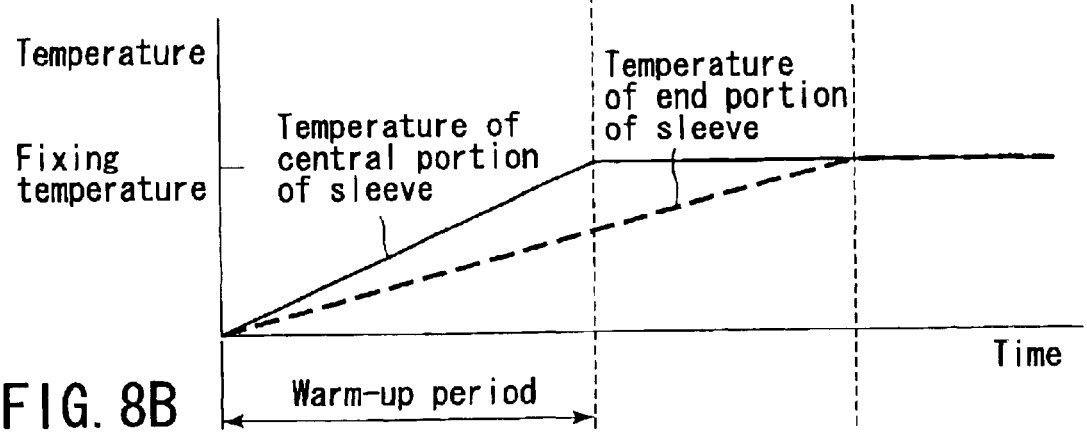
FIG. 8B is a diagram showing examples of the sense temperature of a central portion temperature sensor and the sense temperature of an end portion temperature sensor in correspondence to FIG. 8A.

FIG. 8A is a diagram showing the relation between time required for paper to be supplied to the fixing device 4 and the size of paper supplied to the fixing device 4. FIG. 8B is a diagram showing the relation between time and the temperature of the central portion of the sleeve 46 and the relation between time and the temperature of the end portion of the sleeve 46.

In an example shown in FIG. 8A, after the warm-up process is terminated, sheets of paper with the first size (A5, A4R) are sequentially supplied to the fixing device 4 and then sheets of paper with the second size (A4, A3) are sequentially supplied to the fixing device 4. Further, in an example shown in FIG. 8B, a rise in the temperature of the end portion of the sleeve 46 is gentle in comparison with a rise in the temperature of the central portion of the sleeve 46. The temperature of the end portion of the sleeve 46 is set to the fixing temperature when paper of the second size is supplied to the fixing device 4.

That is, in the examples shown in FIGS. 8A and 8B, when the temperature of the central portion of the sleeve 46 has reached the preset fixing temperature used to fix a toner image on paper, paper of the A5 width having a toner image formed thereon is fed to the fixing device 4. At this time, the temperature of the end portion of the sleeve 46 does not reach the preset fixing temperature. The temperature of the end portion of the sleeve 46 keeps rising even after the end of the warm-up process and reaches the preset fixing temperature when paper of the A4 width is supplied to the fixing device 4.

By the control process as shown in FIGS. 8A and 8B, when the temperature of the central portion of the sleeve 46 has reached the preset fixing temperature, paper of the first size onto which a toner image can be fixed only by use of the central portion of the sleeve 46 is supplied to the fixing device 4. Thus, the fixing device 4 subjects the paper of the first size to the fixing process by use of the central portion of the sleeve 46.

When the fixing process for the paper of the first size is completed, paper of the second size on which a toner image can be fixed by use of the whole portion (central portion and end portion) of the sleeve 46 is supplied to the fixing device 4 in succession to the paper of the first size. When the paper of the second size starts to be supplied, the temperature of the end portion of the sleeve 46 also reaches the fixing temperature. That is, the fixing device 4 is set in a state in which it can perform the fixing process for the paper of the second size when paper of the second size is supplied thereto. Thus, the fixing device 4 performs the fixing process for the paper of the second size supplied in succession to the fixing process for the paper of the first size.

In order to make it possible to perform the control process as shown in FIGS. 8A and 8B, it is necessary to start the warm-up process after the amount of electric power supplied to the central coil 44 and the amount of electric power supplied to the end coil 45 are determined. The amount of electric power supplied to the end coil 45 is an amount of electric power which is required to set the temperature of the end portion of the sleeve 46 to the preset fixing temperature by the time the fixing process for fixing a toner image onto the paper of the first size is terminated.

The amount of electric power supplied to the end coil 45 is determined based on factors such as a temperature of the end portion of the sleeve 46 before the warm-up process, time required for the temperature of the central portion of the sleeve 46 to reach the preset fixing temperature and time required for the toner image forming process and fixing process for all of the sheets of paper with the first size. Based on the above factors, the control section 6 can determine the electric power amount to be supplied to the central coil 44 and the electric power amount to be supplied to the end coil 45.

For example, the amount of electric power supplied to the end coil 45 may be determined based on the number of sheets of paper of the first size (the number of images formed on the sheets of paper of the first size). That is, it is possible to determine an amount of electric power necessary for setting the temperature of the end portion to a preset temperature by the time the fixing process for fixing a toner image onto the paper of the first size is terminated based on the number of paper sheets of the first size.

Further, allocation of the amounts of electric power to be supplied to the coils 44, 45 may be previously stored in the memory 61. For example, the allocation of the amounts of electric power supplied to the central coil 44 and end coil 45 which is determined for the number of paper sheets of the first size subjected to the image forming process is first stored as a table in the memory 61. In this case, the allocation of the amounts of electric power supplied to the coils 44, 45 can be easily determined based on the number of sheets of printing paper of the first size.

As described above, the allocation of the amount of electric power supplied to the central coil 44 and the amount of electric power supplied to the end coil 45 is determined based on the number of sheets of paper of small width (sheets of paper subjected to the fixing process only by use of the region of the central portion of the sleeve).

Thus, two advantages can be attained at the same time. The first advantage is that time from the sleep mode to start of the printing operation can be reduced and the printing operation can be started early. This is because the temperature of the central portion of the sleeve 46 can be rapidly raised by supplying as much electric power as possible to the central coil 44, which heats the central portion of the sleeve 46, at the warm-up time. The second advantage is that the time from start of the printing operation to the end of the printing operation (or time from the sleep mode to the end of the printing operation) can be reduced. This is because the fixing process for large sheets of paper (sheets of paper subjected to the fixing process using the whole portion of the sleeve) follows the fixing process for small sheets of paper.

Next, an example of a method for allocating the amounts of electric power supplied to the coils 44, 45 is explained with reference to FIGS. 9 to 12.

FIGS. 9 to 12 are diagrams showing examples of the electric power supplied to the central coil 44 and the electric power supplied to the end coil 45. In FIGS. 9 to 12, the electric power supplied to the central coil 44 is indicated by a solid line and the electric power supplied to the end coil 45 is indicated by broken lines.

As a method for allocating the amount of electric power supplied to the central coil 44 and the amount of electric power supplied to the end coil 45, the following methods are provided, for example. That is, a method for allocating amounts of electric power supplied to the coils 44, 45 (a first power amount allocation method), a method for allocating times for supplying electric power to the coils 44, 45 (a second power amount allocation method) and a method obtained by combining the above two methods (a third power amount allocation method) are provided.

Figure 9:
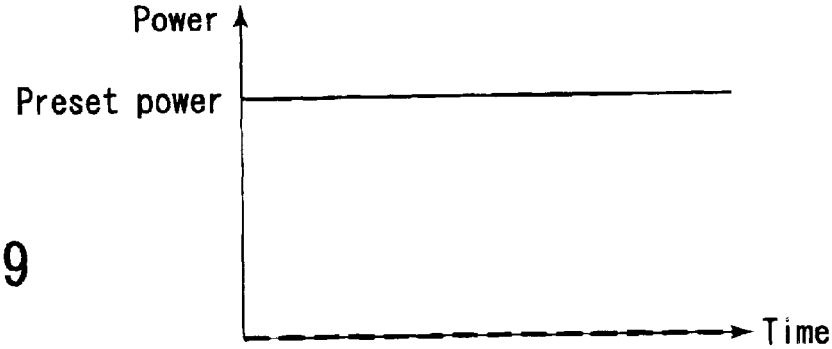
FIG. 9 is a diagram showing the relation between electric power amounts supplied to the respective coils and time when preset electric power is continuously supplied only to the central coil.
Figure 10:
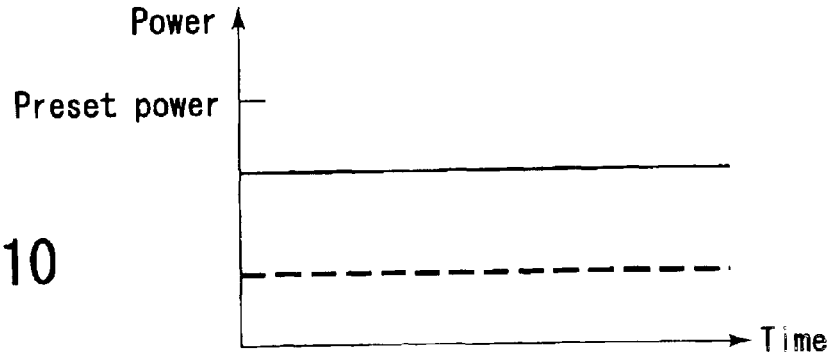
FIG. 10 is a diagram showing an example of the relation between electric power amounts supplied to the respective coils and time in a first power amount allocation method.
Figure 11:
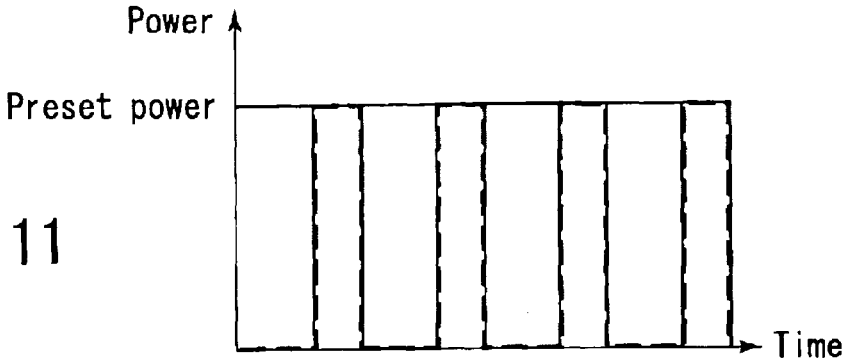
FIG. 11 is a diagram showing an example of the relation between electric power amounts supplied to the respective coils and time in a second power amount allocation method.
Figure 12:
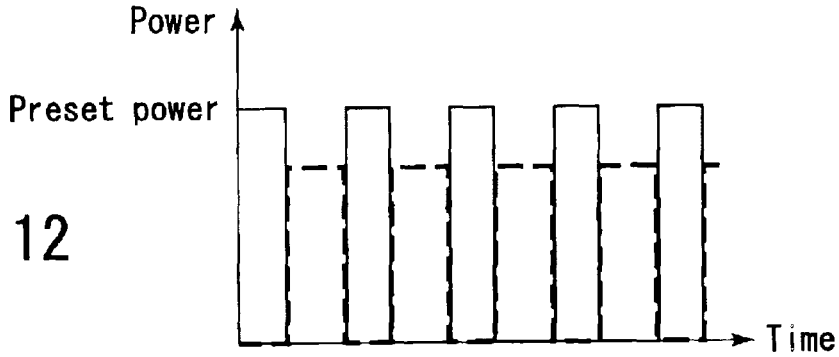
FIG. 12 is a diagram showing an example of the relation between electric power amounts supplied to the respective coils and time in a third power amount allocation method.

FIG. 9 is a diagram showing an example in a case wherein a preset amount of electric power is continuously supplied only to the central coil 44. FIG. 10 is a diagram showing an example in a case wherein preset amounts of electric power are allocated and continuously supplied to the central coil 44 and end coil 45 as an example of the first power amount allocation method. FIG. 11 is a diagram showing an example in a case wherein preset amounts of electric power are allocated for the central coil 44 and end coil 45 for respective time units and preset electric power is supplied to the central coil 44 or end coil 45 for each time unit as an example of the second power amount allocation method. FIG. 12 is a diagram showing an example in a case wherein electric power amounts allocated for the central coil 44 and end coil 45 are supplied for each time unit as an example of the third power amount allocation method.

First, the first power amount allocation method for allocating electric power to the coils 44, 45 is explained.

As shown in FIG. 10, the first power amount allocation method is to continuously supply electric power allocated to the central coil 44 and electric power allocated to the end coil 45 irrespective of time. For example, the first power amount allocation method is to allocate preset electric power (available electric power) into electric power to be supplied to the central coil 44 and electric power to be supplied to the end coil 45 and continuously supply the allocated electric power amounts to the respective coils. Thus, the amounts of electric power supplied to the central coil 44 and electric power supplied to the end coil 45 can be controlled.

In the first power amount allocation method, a state in which both of the coils 44, 45 are continuously energized is set irrespective of time. Therefore, according to the first power amount allocation method, it is possible to achieve an advantage that supply of electric power to each of the coils 44, 45 can be easily controlled and high efficiency of supply of electric power can be attained.

Next, the second power amount allocation method for allocating times in which electric power amounts are supplied to the coils 44, 45 is explained.

As shown in FIG. 11, the second power amount allocation method is to allocate and supply preset electric power (available electric power) to the central coil 44 and end coil 45 for respective divided periods of time. For example, in the second power amount allocation method, a time period in which electric power is supplied to the central coil 44 and a time period in which electric power is supplied to the end coil 45 are previously set. Then, the operation of supplying electric power to the central coil 44 and the operation of supplying electric power to the end coil 45 are periodically performed. As a result, the amounts of electric power supplied to the central coil 44 and electric power supplied to the end coil 45 can be controlled.

According to the second power amount allocation method, large electric power amounts can be simultaneously supplied to the central coil 44 and end coil 45. Therefore, it is possible to attain an advantage that the temperature of a specified region of the fixing member can be raised in a short period of time and the temperature control process for the fixing member can be easily performed. For example, even when the temperature of the sleeve 46 used as the fixing member is lowered, it can be rapidly heated. The second power amount allocation method is suitable for the operation control process of the image forming apparatus such as a digital copying machine, printer or facsimile.

Next, the third power amount allocation method is explained.

As shown in FIG. 12, the third power amount allocation method is obtained by a combination of the first and second power amount allocation methods.

The third power amount allocation method is to previously set power amounts respectively supplied to the coils 44, 45 and supply set power amounts to the coils for respective periods of time. In the third power amount allocation method, for example, a power amount supplied to the center coil 44 and a time zone in which the power amount is supplied, and a power amount supplied to the end coil 45 and a time zone in which the power amounts is supplied are previously set and power supply to the center coil 44 and power supply to the end coil 45 are periodically performed. Thus, the power amount supplied to the center coil 44 and the power amount supplied to the end coil 45 can be controlled.

Different temperature variations will occur on the fixing member of the sleeve 46 according to the operating conditions and operation environment of the copying machine 1, a significant lowering in temperature may occur in one portion and only a small lowering in temperature may occur in another portion. For example, while the fixing process is being performed, the speeds of lowering the temperatures are different in a portion of the sleeve 46 which is brought into contact with paper and in a portion which is not brought into contact with paper.

In the third power amount allocation method, it is necessary to rapidly heat a portion of the fixing member in which the temperature is rapidly lowered (a region of the fixing member in which a significant temperature variation occurs). Therefore, a power amount supplied to the heater (coil) which treats the portion in which the temperature is rapidly lowered is set to a little larger amount. On the other hand, it is not necessary to rapidly heat a portion of the fixing member in which the temperature is not rapidly lowered (a region of the fixing member in which a smooth temperature variation occurs). Therefore, a power amount supplied to the heater (coil) which copes with the portion in which the temperature is not rapidly lowered is set to a little smaller amount. Thus, since the control operation can be performed based on the power amount supplied in addition to the temperature control operation according to time, the precise temperature control operation can be performed with respect to the fixing member and the power amount can be efficiently utilized.

Next, another example of the configuration of the fixing device 4 is explained.

Figure 13:
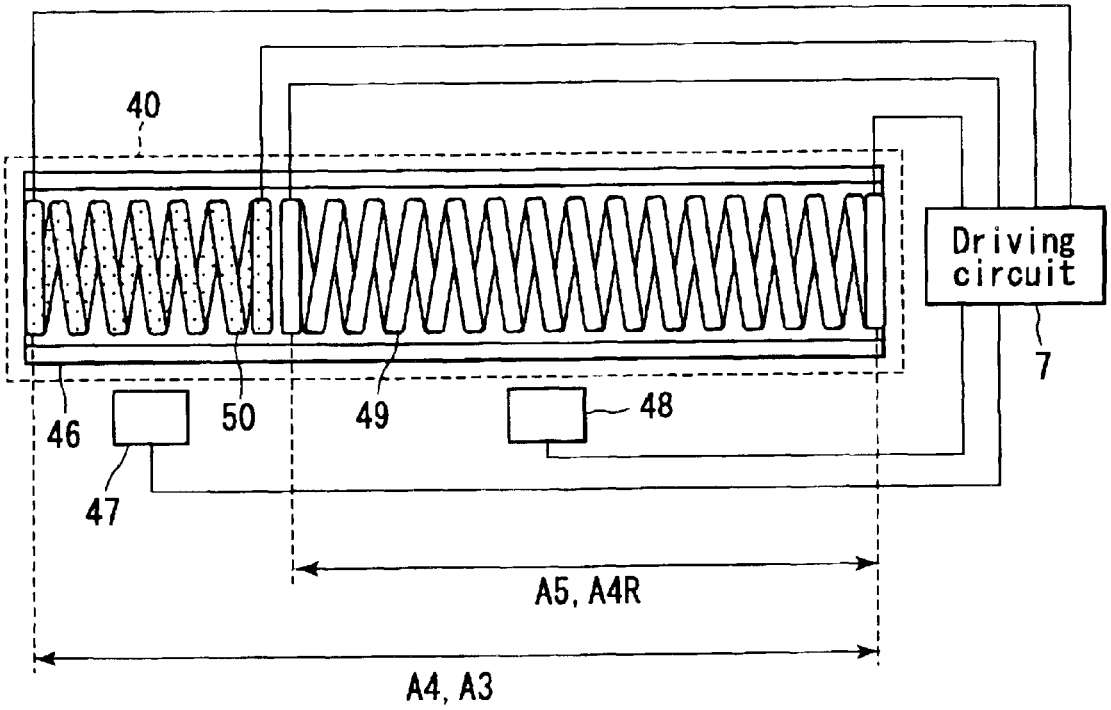
FIG. 13 is a cross sectional view schematically showing an example of another configuration of the fixing device.

FIG. 13 shows an example of the configuration of the fixing device to which paper is supplied with the end portion of the sleeve 46 used as a reference.

In the fixing device of the example of the configuration shown in FIG. 3, the central position of the sheet of paper is passed along the central position of the sleeve 46. Therefore, the coil in the sleeve 46 in the configuration of FIG. 3 is divided into the center coil 44 and end coils 45 according to the paper width. On the other hand, in the fixing device of the example of the configuration shown in FIG. 13, one end portion of the sheet of paper is passed along one end portion of the sleeve 46. Therefore, a heater which is divided into a main coil 49 and sub-coil 50 according to the paper width is provided in the sleeve 46 in the configuration of FIG. 13.

The main coil 49 is used to heat a portion of the sleeve 46 corresponding to a sheet of paper of A5, A4R width. In this case, a portion of the sleeve 46 which is heated by the main coil 49 is defined as a main portion.

Further, the sub-coil 50 is used to heat a portion of the sleeve 46 other than the heating range of the main coil 49. That is, the sub-coil 50 is used to heat the whole portion of the sleeve 46 (a portion corresponding to the A4, A3 width other than the heating range of the main coil 49). In this case, a portion of the sleeve 46 which is heated by the sub-coil 50 is defined as a sub-portion.

Like the center coil 44 and end coil 45, a high-frequency current (power) is supplied from the driving circuit 7 to the main coil 49 and sub-coil 50. The coils 49, 50 cause a variation in the high-frequency magnetic field due to the high-frequency current from the driving circuit 7, cause an induction current to flow in the conductive sleeve 46 and generate Joule heat.

Further, in a position corresponding to the main portion of the sleeve 46, a main portion temperature sensor 48 is provided. The main portion temperature sensor 48 is used to sense the temperature of the main portion of the sleeve 46. In a position corresponding to the sub-portion of the sleeve 46, a sub-portion temperature sensor 47 is provided. The sub-portion temperature sensor 47 is used to sense the temperature of the sub-portion of the sleeve 46. Temperature information items sensed by the sub-portion temperature sensor 47 and main portion temperature sensor 48 are supplied to the CPU 70 of the driving circuit 7. Thus, the CPU 70 controls a power amount supplied from the driving power supply 71.

In the example of the configuration shown in FIG. 13, the configuration can be made simple in comparison with the configuration in which the end coils 45 are provided on both end portions as shown in FIG. 3.

The main coil 49 corresponds to the center coil 44 in the configuration of FIG. 3. The same control operation as that for the center coil 44 is performed for the main coil 49. The sub-coil 50 corresponds to the end coil 45 in the configuration of FIG. 3. The sub-coil 50 is controlled in the same manner as the end coil 45. Further, the main portion temperature sensor 48 corresponds to the central portion temperature sensor 41 in the configuration of FIG. 3. The sub-portion temperature sensor 47 corresponds to the end portion temperature sensor 42 in the configuration of FIG. 3.

That is, like the fixing device with the configuration shown in FIG. 3, the fixing device with the configuration shown in FIG. 13 can be operated as explained in the present embodiment.

Figure 14:
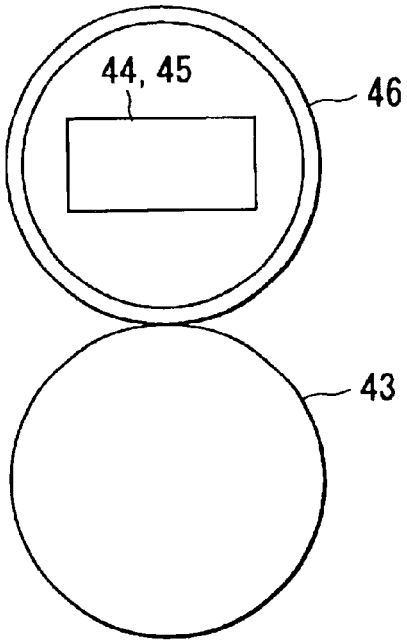
FIG. 14 is a cross sectional view showing the schematic configuration of the fixing device using a sleeve as a fixing member.

FIG. 14 is a cross sectional view showing the cylindrical sleeve 46 used as the fixing member as shown in FIG. 3 or 13.

In FIG. 14, the cylindrical sleeve 46 is shown as the fixing member used to cause an induction current and generate heat. However, the fixing member is not limited to the cylindrical sleeve 46 shown in FIG. 14. The fixing member may be configured as shown in FIGS. 15, 16, for example.

Figure 15:
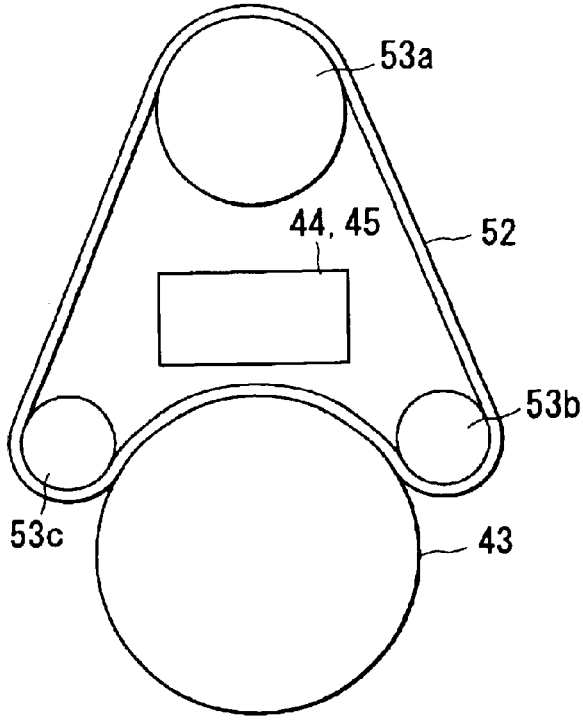
FIG. 15 is a cross sectional view showing the schematic configuration of the fixing device using a heating belt.

FIG. 15 is a view showing an example of the configuration of the fixing device using a heating belt 52. The heating belt 52 is configured in a belt form in which a belt is supported by a plurality of supporting members 53*a*, 53*b*, 53*c*. The heating belt 52 generates heat (or is heated) caused by an eddy current occurring in the center coil 44 and end coil 45.

Figure 16:
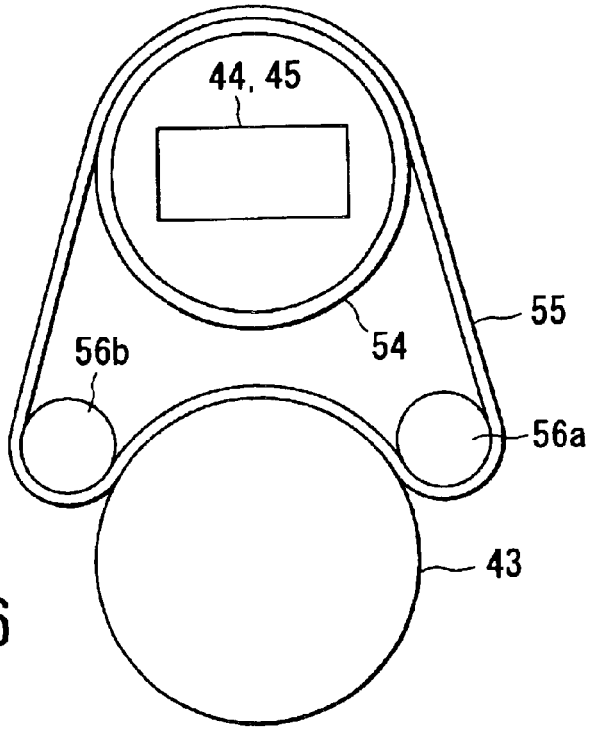
FIG. 16 is a cross sectional view showing the schematic configuration of the fixing device of a type in which an intermediate body used to transmit heat from a heating body is provided.

FIG. 16 is a view showing an example of the configuration of the fixing device using a heat transmission belt 55 used to transmit heat from a heating body 54. The heating body 54 has the same configuration as that of the sleeve 46 shown in FIG. 14. A coil 51 used as a heater is provided in the cylindrical member of the heating body 54. Thus, the heating body 54 generates heat (or is heated) caused by an eddy current occurring in the center coil 44 and end coil 45. The heat transmission belt 55 is configured in a belt form in which a belt is supported by a plurality of supporting members 56*a*, 56*b*. The heat transmission belt 55 is heated by heat generated by the heating body 54. That is, the heat transmission belt 55 functions as a intermediate body to transmit heat generated by the heating body 54.

The center coil 44 and end coil 45 shown in FIGS. 15 and 16 can be operated in the same manner as in the first and second operation examples.

Further, in the above explanation, as indicated by the center coil 44 (or the main coil 49) and the end coil 45 (or sub-coil 50), a case wherein this embodiment is applied to the fixing device of IH (Induction Heater) coil heating system is explained. However, this invention is not limited to the fixing device of IH coil heating system and can be applied to a fixing device of a heating system using a heater such as a lamp.

For example, the control operation explained in the present embodiment can be applied to a fixing device with the configuration in which a plurality of heating lamps are independently provided for respective heating ranges. Also, in this case, power amounts supplied to the respective heating lamps can be controlled. Further, in another heating system, the control operation explained in the present embodiment can be applied to a fixing device using a plurality of heaters independently provided in respective heating ranges and used to heat the respective portions if power amounts supplied to the respective heaters can be controlled.

In the example of the configuration shown in FIG. 1, the control section 6 and driving circuit 7 are explained as different circuits, but they can be realized as one control unit. In this case, the control unit can be made small.

The embodiment explained above can be applied to an image forming apparatus such as an MFP (Multi-Function Peripheral). An MFP is a device which can input data such as an image via a public communication line such as a network or telephone line and print input data such as an image on paper.

As described above, in the present embodiment, in an image forming apparatus such as a copying machine having a fixing device including coils respectively divided for a plurality of systems, allocated power amounts to be supplied to the coils for the respective systems are set according to the size of paper at the warm-up time.

Thus, according to the present embodiment, power to heat a portion which is not necessary to be heated can be saved and corresponding power can be supplied to a heater used to heat a portion which is required to be heated. As a result, the warm-up period or a period of time required to perform the image forming process can be reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image input section which inputs an image, a size selection section which selects a size of a recording medium on which an image input by the image input section is formed, a toner image forming section which forms a toner image of the image input by the image input section on the recording medium with the size selected by the size selection section, a fixing section having a fixing member which heats and fixes the toner image formed on the recording medium by the toner image forming section onto the recording medium, and a heater divided into a plurality of systems used to respectively heat a plurality of divided regions of the fixing member, and a control section which determines allocation power amounts to be supplied to the respective systems of the heater according to the size of the recording medium selected by the size selection section and supplies the allocation power amounts to the respective systems of the heater when the fixing member is required to be warmed up, wherein the heater is an induction heater which heats the fixing member by induction heating according to the power supplied from the control section.

2. An image forming apparatus comprising:

an image input section which inputs an image, a size selection section which selects a size of a recording medium on which an image input by the image input section is formed, a toner image forming section which forms a toner image of the image input by the image input section on the recording medium with the size selected by the size selection section, a fixing section having a fixing member which heats and fixes the toner image formed on the recording medium by the toner image forming section onto the recording medium, and a heater divided into a plurality of systems used to respectively heat a plurality of divided regions of the fixing member, and a control section which determines allocation power amounts to be supplied to the respective systems of the heater according to the size of the recording medium selected by the size selection section and supplies the allocation power amounts to the respective systems of the heater when the fixing member is required to be warmed up, and an image rearranging section used to change an output order of images and in which the image input section sequentially inputs a plurality of images, the size selection section selects the size of a recording medium for each of the images input by the image input section, the image rearranging section rearranges the plurality of images input by the image input section in order of small size of the recording medium selected by the size selection section, and the control section determines allocation of power amounts to be supplied to the respective systems of the heater based on the order of the images rearranged by the image rearranging section.

3. The image forming apparatus according to claim 2, wherein the heater includes a first system which heats a first region of the fixing member to perform a fixing process with respect to a recording medium of a first size and a second system which heats a second region of the fixing member to perform a fixing process with respect to a recording medium of a second size larger than the recording medium of the first size, the size selection section selects one of the recording medium of the first size and the recording medium of the second size larger than the recording medium of the first size for each of the images input by the image input section, the image rearranging section rearranges the order of the images input by the image input section to put the image to be formed on the recording medium of the first size before the image to be formed on the recording medium of the second size, and the control section determines allocation of a power amount to be supplied to the first system of the heater and a power amount to be supplied to the second system of the heater to first set the temperature of the first region to the fixing temperature and then set the temperature of the second region to the fixing temperature.

4. The image forming apparatus according to claim 3, wherein the toner image forming section forms toner images of the images on recording media of sizes selected by the size selection section in an order rearranged by the image rearranging section and sequentially supplies the recording media having the toner images formed thereon to the fixing section, and the control section determines allocation of a power amount to be supplied to the first system of the heater and a power amount to be supplied to the second system thereof to set the temperature of the second region to the fixing temperature before the recording medium of the second size on which the toner image is formed by the toner image forming section is fed to the fixing section.

5. The image forming apparatus according to claim 4, wherein the control section determines allocation of the power amount to be supplied to the first system of the heater and the power amount to be supplied to the second system of the heater based on the number of images for which the recording media of the first size selected by the size selection section are used.

6. The image forming apparatus according to claim 2, wherein the control section determines power amounts to be continuously supplied to the respective systems of the heater by allocating preset power amounts to the respective systems of the heater based on the order of images rearranged by the image rearranging section.

7. The image forming apparatus according to claim 2, wherein the control section determines periods of time during which preset power amounts are supplied to the respective systems of the heater based on the order of images rearranged by the image rearranging section.

8. The image forming apparatus according to claim 2, wherein the control section determines power amounts to be supplied to the respective systems of the heater and periods of time during which the preset power amounts are supplied to the respective systems of the heater based on the order of images rearranged by the image rearranging section.

9. A control method for an image forming apparatus which includes an image input section which inputs an image, a toner image forming section which forms a toner image of the image input by the image input section on a recording medium with a selected one of various sizes, and a fixing section having a fixing member which heats and fixes the toner image formed on the recording medium by the toner image forming section onto the recording medium and a heater divided into a plurality of systems used to respectively heat a plurality of divided regions of the fixing member, comprising:

sequentially inputting a plurality of images by use of the image input section, selecting sizes of recording media for the images input by the image input section, rearranging the images input by the image input section in order of small size of the recording medium, determining allocation power amounts to be supplied to the respective systems of the heater based on the order of the images rearranged by rearranging the images, and supplying the power amounts allocated to the respective systems of the heater to the respective systems of the heater.

10. The method for the image forming apparatus according to claim 9, wherein the heater includes a first system which heats a first region of the fixing member to perform a fixing process with respect to a recording medium of a first size and a second system which heats a second region of the fixing member to perform a fixing process with respect to a recording medium of a second size larger than the recording medium of the first size, the selection of the size of the recording medium being to select one of the recording medium of the first size and the recording medium of the second size for each of the images input by the image input section, the image rearranging being to rearrange the order of the images input by the image input section to put the image for which the recording medium of the first size is selected before the image for which the recording medium of the second size is selected, and allocation of a power amount to be supplied to the first system of the heater and a power amount to be supplied to the second system of the heater is determined to first set the temperature of the first region of the fixing member to the fixing temperature and then set the temperature of the second region of the fixing member to the fixing temperature.

11. The method for the image forming apparatus according to claim 10, wherein allocation of the power amount to be supplied to the first system of the heater and the power amount to be supplied to the second system of the heater is determined to set the temperature of the second region of the fixing member to the fixing temperature after the first region of the fixing member was first set to the fixing temperature and before the recording medium of the second size on which the toner image is formed by the toner image forming section is fed to the fixing section.

12. The method for the image forming apparatus according to claim 11, wherein allocation of the power amount to be supplied to the first system of the heater and the power amount to be supplied to the second system of the heater is determined based on the number of recording media of the first size selected.

13. The method for the image forming apparatus according to claim 9, wherein allocation of the power amount to be supplied to the first system of the heater and the power amount to be supplied to the second system of the heater is determined by allocating power amounts to be continuously supplied to the respective systems of the heater by use of a preset power amount based on the order of the images rearranged by the image rearranging.

14. The method for the image forming apparatus according to claim 9, wherein allocation of the power amount to be supplied to the first system of the heater and the power amount to be supplied to the second system of the heater is determined by allocating periods of time in which the preset power amounts are supplied to the respective systems of the heater based on the order of the images rearranged by the image rearranging.

15. The method for the image forming apparatus according to claim 9, wherein allocation of the power amount to be supplied to the first system of the heater and the power amount to be supplied to the second system of the heater is determined by allocating power amounts to be supplied to the respective systems of the heater and periods of time in which the preset power amounts are supplied to the respective systems of the heater based on the order of the images rearranged by the image rearranging.

* * * * *